US006796934B1

(12) United States Patent
McAlister et al.

(10) Patent No.: US 6,796,934 B1
(45) Date of Patent: Sep. 28, 2004

(54) FLOW CONTROL VALVE FOR CONTINUOUS DISCHARGE CENTRIFUGAL CONCENTRATORS

(75) Inventors: Steven A. McAlister, Abbotsford (CA); Mark Henry Vinchoff, Chilliwack (CA); Stephen Scott Thomas, Reno, NV (US)

(73) Assignee: Falcon Concentrators Inc., Langley (CA)

( * ) Notice: Subject to any disclaimer, the term of this patent is extended or adjusted under 35 U.S.C. 154(b) by 0 days.

(21) Appl. No.: 09/701,090

(22) PCT Filed: May 21, 1999

(86) PCT No.: PCT/CA99/00428

§ 371 (c)(1),
(2), (4) Date: Feb. 27, 2001

(87) PCT Pub. No.: WO99/61161

PCT Pub. Date: Dec. 2, 1999

(30) Foreign Application Priority Data

May 26, 1998 (CA) ..... 2238897

(51) Int. Cl.[7] ..... B04B 11/04
(52) U.S. Cl. ..... 494/56
(58) Field of Search ..... 494/27–31, 36, 494/43, 45, 57, 80; 210/380.1

(56) References Cited

U.S. PATENT DOCUMENTS 1,882,389 A * 10/1932 MacIsaac
3,047,008 A * 7/1962 Clarkson
3,090,591 A 5/1963 Clarkson
3,823,869 A * 7/1974 Loison
3,955,758 A * 5/1976 Loison
4,279,741 A * 7/1981 Campbell
4,347,971 A * 9/1982 Novoselac
4,454,041 A * 6/1984 Kelsey
4,898,666 A * 2/1990 Kelsey
4,998,986 A * 3/1991 Campbell
5,338,284 A * 8/1994 Knelson
5,462,513 A 10/1995 McAlister
5,601,523 A * 2/1997 Knelson
6,149,572 A * 11/2000 Knelson

FOREIGN PATENT DOCUMENTS

DE 1632324 * 10/1970
DE 4402041 C1 * 8/1995
GB 973457 10/1964
GB 1465311 * 2/1977
GB 2133722 * 8/1984

OTHER PUBLICATIONS

Thompson, Della (9 eds), *The Concise Oxford Dictionary of Current English,* Oxford University Press, Oxford, 1995, pp. 1550–1551.

* cited by examiner

*Primary Examiner*—Charles E. Cooley
(74) *Attorney, Agent, or Firm*—Seed IP Law Group PLLC

(57) ABSTRACT

Prior continuous discharge centrifugal concentrators for separating higher density particles from a slurry have used pinch valves to control the flow of discharge. Such pinch valves tend to be blocked by coarse particles, requiring shutdown of the machine. The present invention provides a muscle-type valve to provide a circular orifice for the valve bore of continuously variable perimeter.

16 Claims, 8 Drawing Sheets

FLOW CONTROL VALVE FOR CONTINUOUS DISCHARGE CENTRIFUGAL CONCENTRATORS

The present invention relates to centrifugal concentrators of the rotating bowl type and other enhanced gravity machines for the separation of solids of higher density such as gold, iron or tin from a slurry containing solids of a lower density and liquid and more particularly such machines in which the target concentrate is continuously discharged.

BACKGROUND OF THE INVENTION

Various centrifugal concentrators and other enhanced gravity machines are known which separate particles of high density such as gold, iron or tin from tailings and other slurry streams in a manner whereby the concentrate is discharged continuously rather than in a batch process requiring periodic shutdown of the machine. Generally such concentrators have utilized pinch valves or fixed orifice spigots to control the release of the concentrate from the rotating machine. For example, the present inventor's continuous discharge centrifugal concentrator which is the subject of U.S. Pat. No. 5,462,513 issued 31 Oct. 1995 utilizes flow control valves to control the discharge of concentrate which are air controlled mini pinch valves constructed with sleeves of the type manufactured by Linatex Inc. Each mini pinch valve has a central bore in which is positioned the flexible cylindrical sleeve of abrasion resistant material. By applying air pressure to the exterior surface of the sleeve, the sleeve is compressed and closes off the central bore, preventing the passage of concentrate. When air pressure to the valve is reduced the sleeve opens and material may flow through the valve. Another continuous discharge separator is disclosed in Knelson U.S. Pat. No. 5,338,284 issued Aug. 16, 1994. That device similarly utilizes a standard pinch valve to control the flow of discharged concentrate. Similarly, in the continuous discharge separator disclosed in Knelson U.S. Pat. No. 5,601,523 issued Feb. 11, 1997, pinch valves are used to control the flow of discharged concentrate.

The use of standard pinch valves to control discharge of concentrate from enhanced gravity machines carries with it a number of problems. In a pinch valve, the circular sleeve is typically compressed between two planes, causing the cross-section shape of the sleeve to be flattened, without reducing the circumference of the orifice. When the opening in the valve is reduced to reduce flow, the flattened cross-section thus created tends to trap coarse particles which can quickly cause the passage to become blocked, and can only be dislodged by fully opening the valves. Also, the sleeves are more easily torn by coarse particles when stretched and under tension. Alternatively, the valve can be operated in an on/off mode. This creates more problems. First, if this technique is to be effective, the valve needs to be cycled very rapidly, which causes failure after a few hundred hours of operation. Second, on/off cycling creates discrete bursts which may allow valuable material to bypass and cause barren material to be captured.

Other types of concentrators which provide a continuous discharge of concentrated fractions through small spigots having fixed orifices are the "Kelsey jig" disclosed in Kelsey U.S. Pat. No. 4,454,041 issued Jun. 12, 1984, and U.S. Pat. No. 4,898,666 issued Feb. 6, 1990; and the "Campbell jig" disclosed in Campbell U.S. Pat. No. 4,279,741 issued Jul. 21, 1981, and U.S. Pat. No. 4,998,986 issued Feb. 6, 1990. In such machines, is desirable to minimize the amount of water flowing out the concentrate discharge by minimizing the diameter of the spigot orifice. However this leads to blockage of the orifice by coarse particles, which causes imbalance in the rotor and requires shut-down of the machine.

Flow control valves of the type called "radially constrictible unobstructed venturi valves" have been used in the past in pipelines. A particular type of these valves, called "muscle valves" have been developed by The Clarkson Company of Reno, Nevada for use as low-pressure throttling control valve in pipeline systems. The basic design of such flow control valves is disclosed in U.S. Pat. No. 3,090,591 issued May 21, 1963. Such valves have not previously been used in rotating systems or gravity enhanced concentrators where high pressures are encountered. Unlike pinch valves, they utilize a "muscle"—a rubber part which uniformly constricts the sleeve so that as the sleeve diameter is reduced it maintains a circular cross-section.

There is therefore a need for a continuous discharge centrifugal concentrator having flow control valves which have the advantages of "muscle valves".

SUMMARY OF THE INVENTION

The present invention provides, in an enhanced gravity machine for separating particulate material of higher specific gravity from particulate material of lower specific gravity, comprising a) a rotating member adapted for rotation about an axis, (b) material supply means to deliver the particulate material into the rotating member, c) a plurality of cavities extending outwardly with respect to the axis of rotation of the rotating member, the cavities each having an outlet, and d) flow controlling means for controlling the flow of material from the outlets of the cavities; the improvement wherein the flow control valves are adapted to provide an orifice of continuously variable perimeter over a substantial range of operating cross-sectional areas.

BRIEF DESCRIPTION OF THE DRAWINGS

In drawings which illustrate a preferred embodiment of the invention.

DETAILED DESCRIPTION OF A PREFERRED EMBODIMENT

Figure 1:
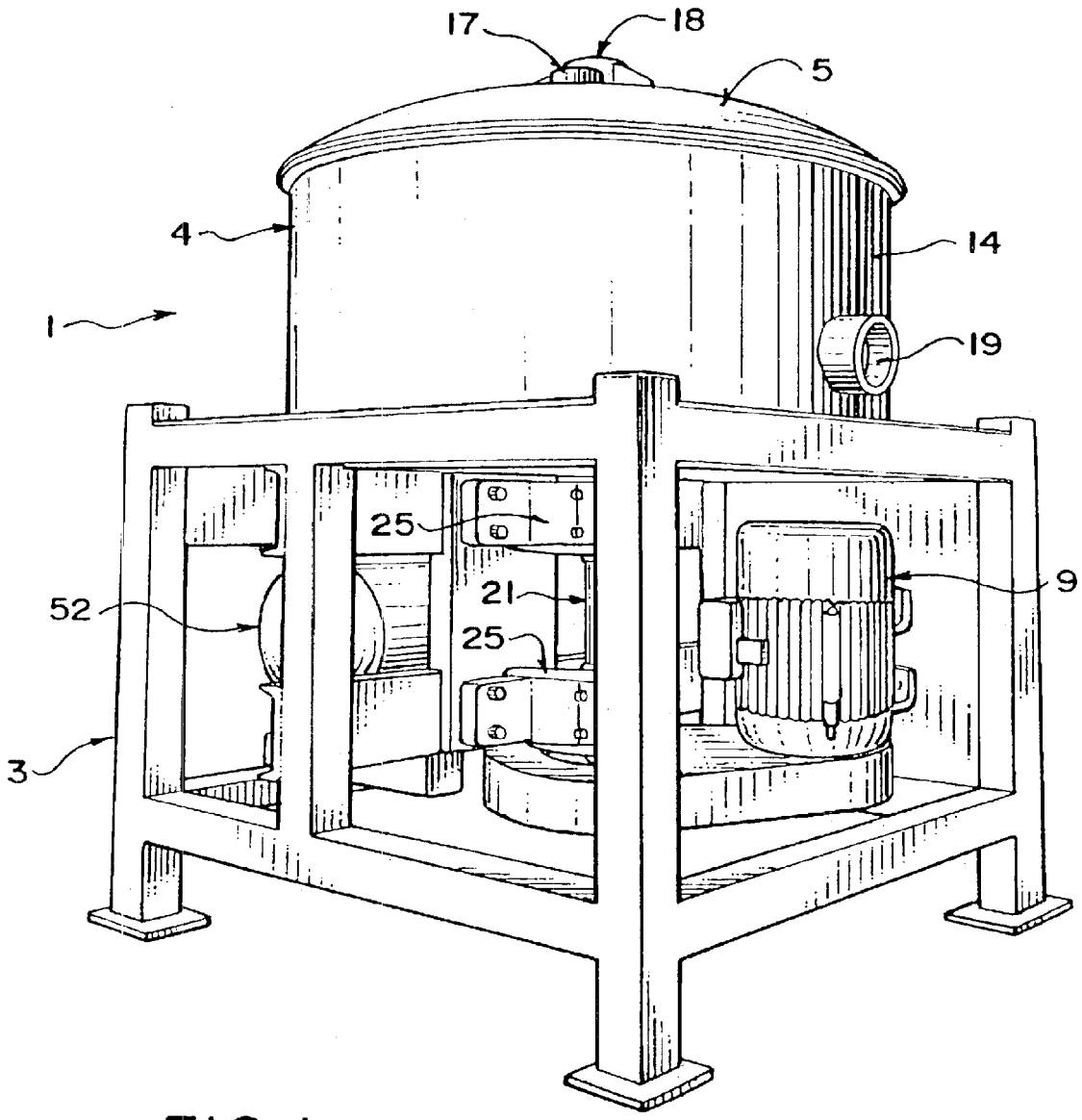
FIG. 1 is a perspective view of a centrifuge incorporating the invention.
Figure 2:
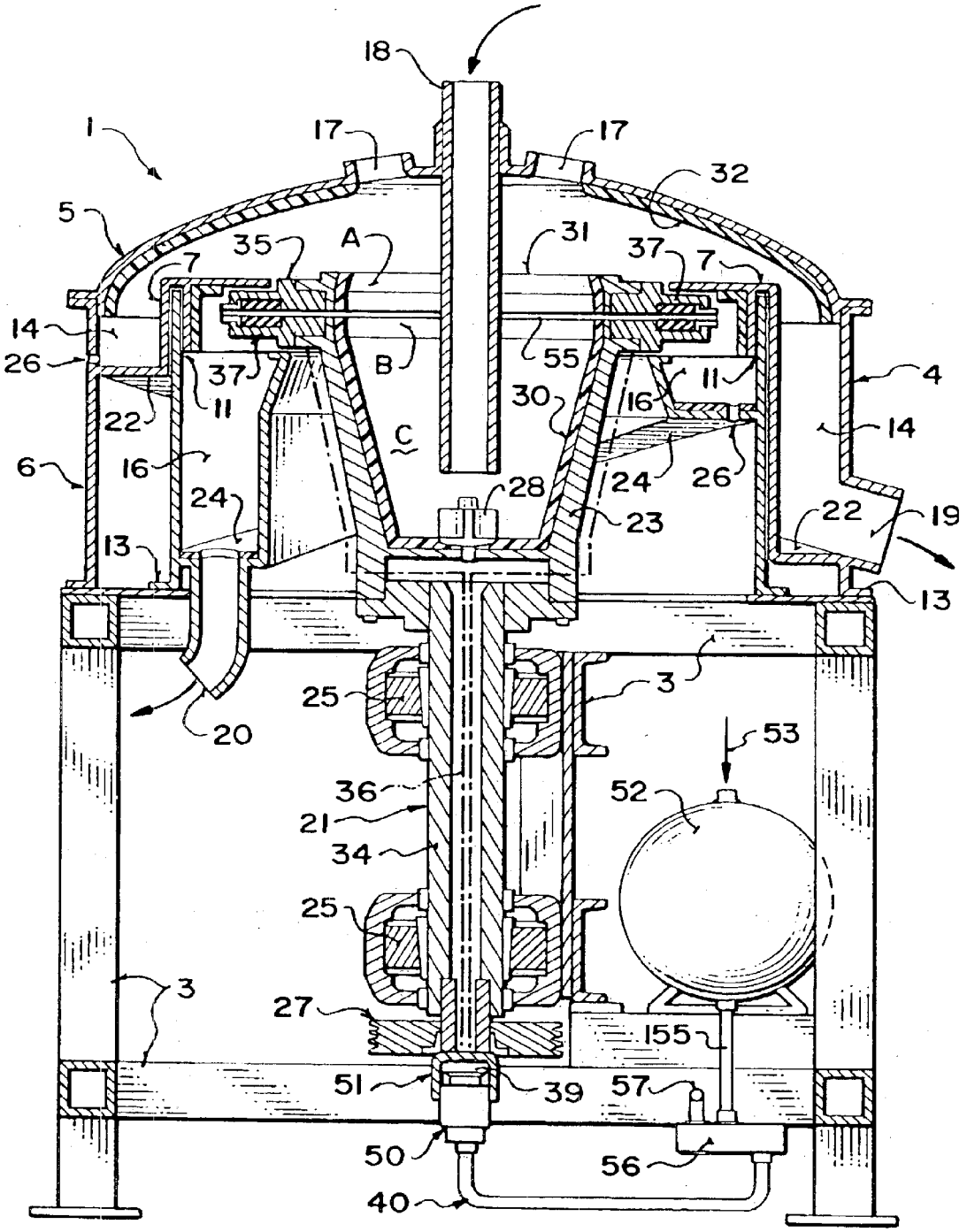
FIG. 2 is a vertical cross-sectional view of the centrifuge shown in FIG. 1.
Figure 3:
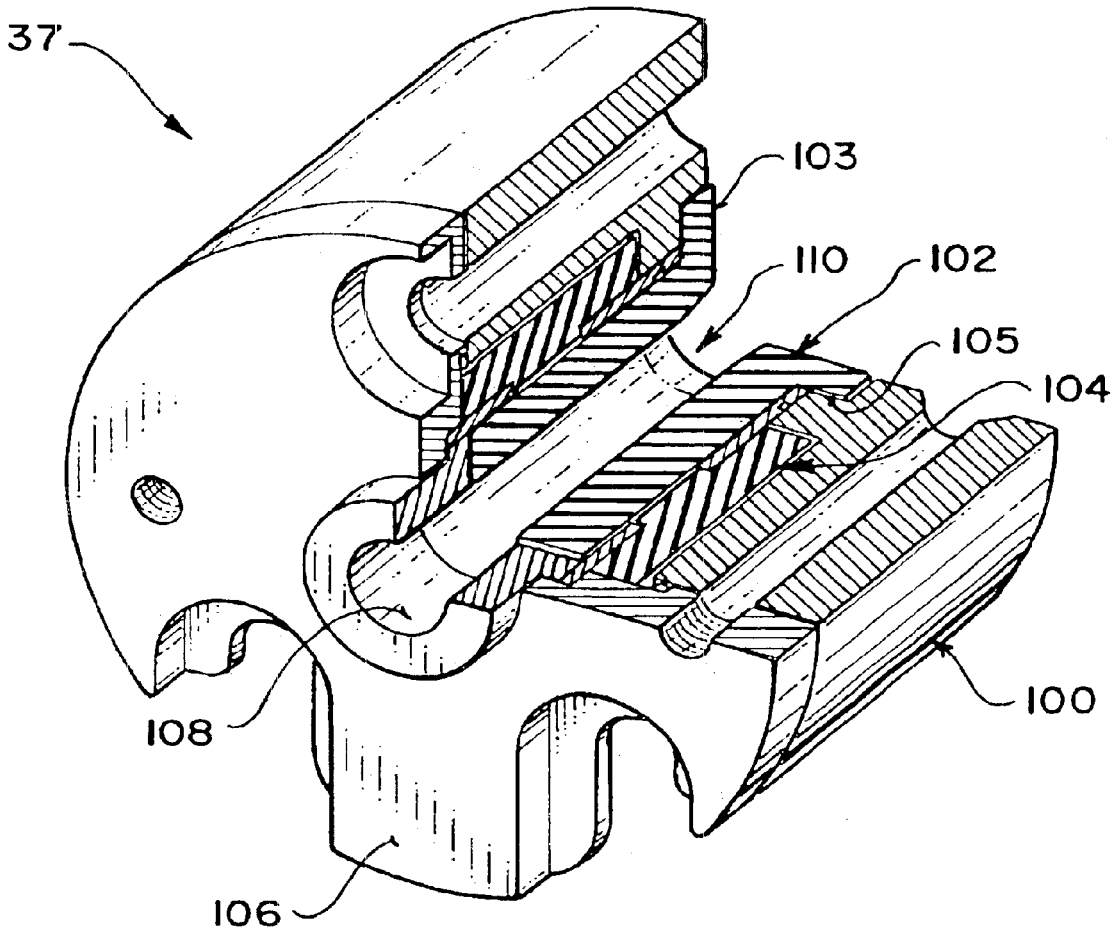
FIG. 3 is a perspective cut-away view of the flow control valve of the invention.
Figure 4:
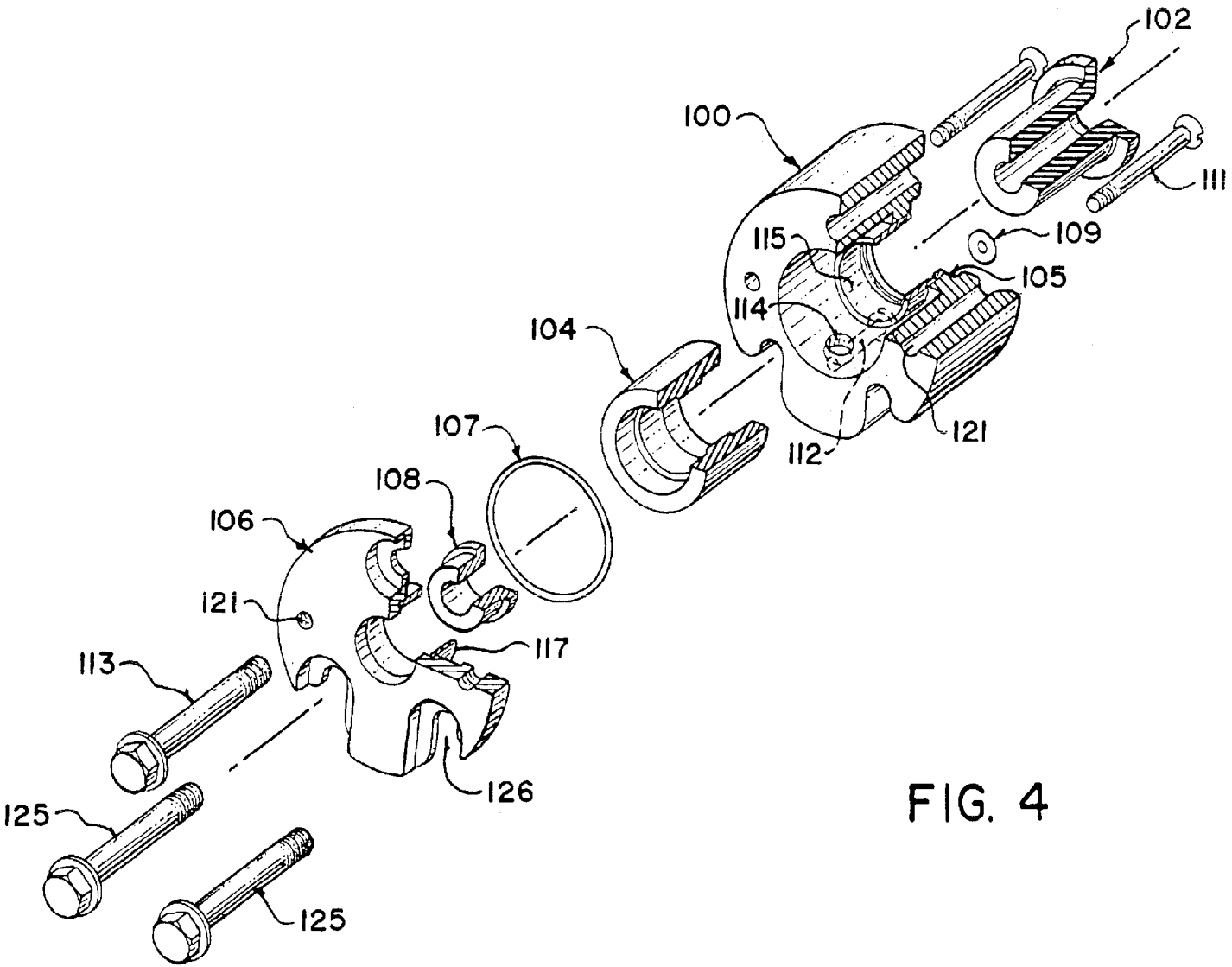
FIG. 4 is an exploded perspective cut-away view of the flow control valve of the invention.
Figure 5:
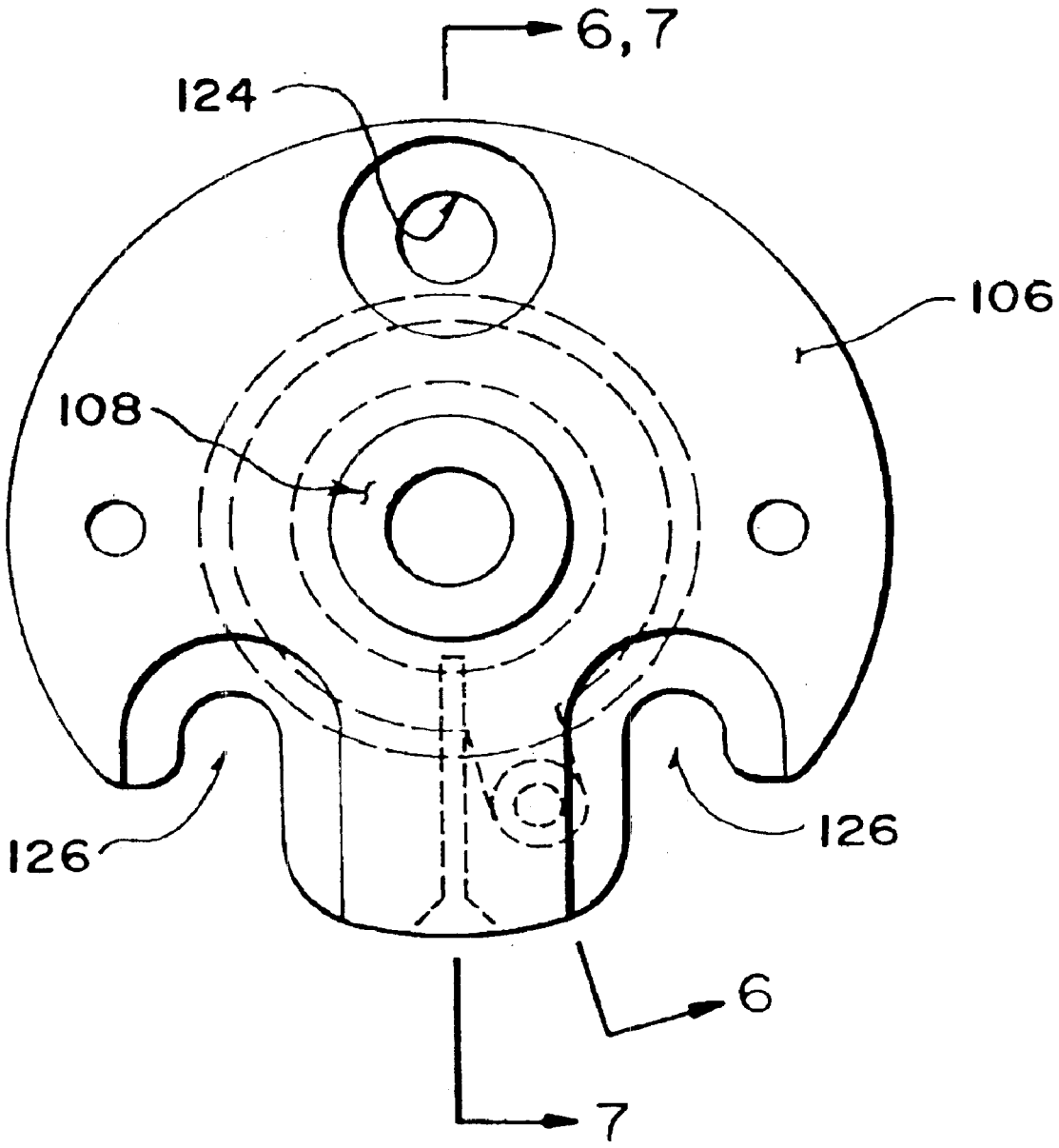
FIG. 5 is an end view of the flow control valve shown in FIG. 3.
Figure 7:
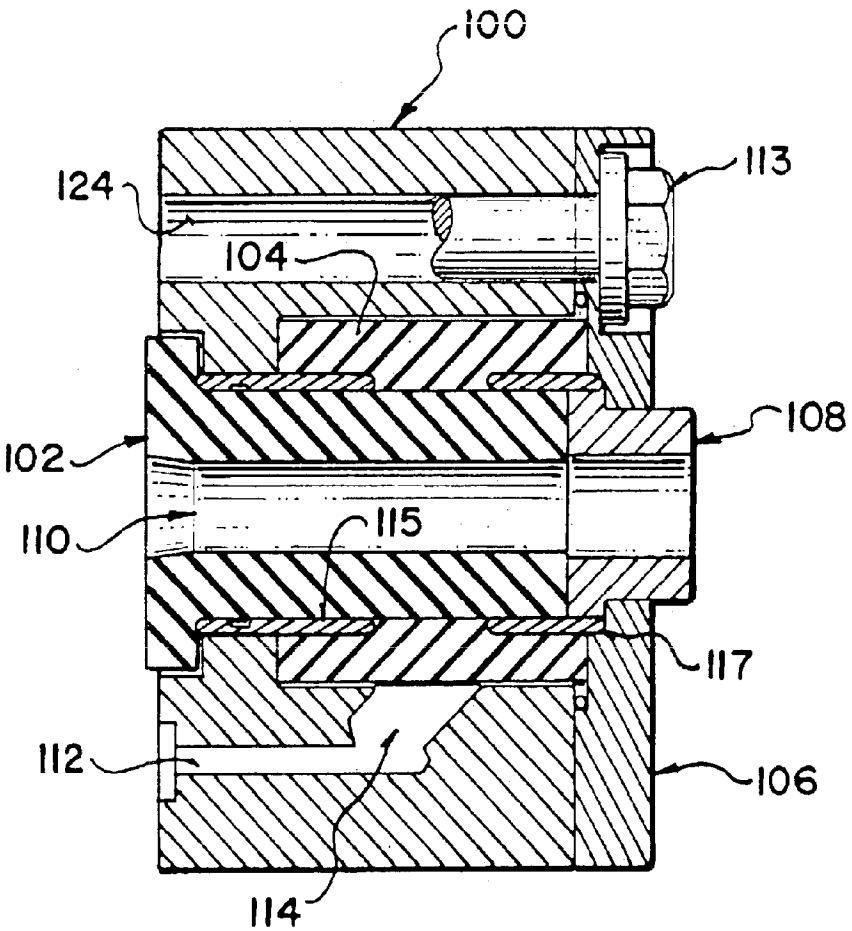
FIG. 7 is a cross-sectional view of the flow control valve shown in FIG. 5 taken along lines 7—7.
Figure 6:
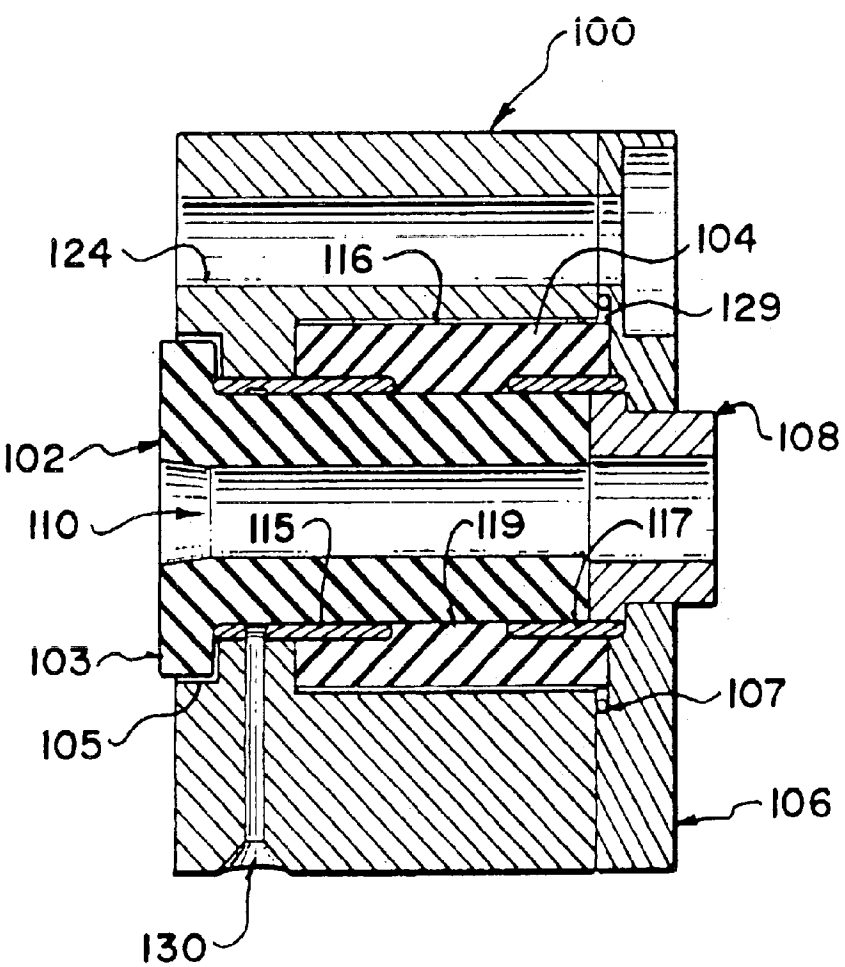
FIG. 6 is a cross-sectional view of the flow control valve shown in FIG. 5 taken along lines 6—6.
Figure 8:
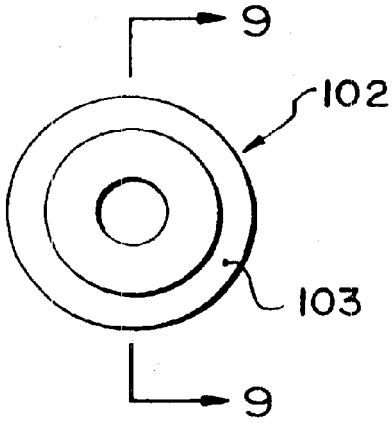
FIG. 8 is an end view of the valve sleeve.
Figure 9:
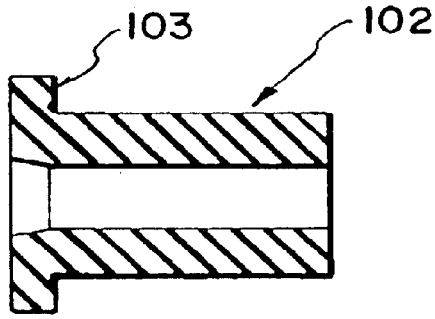
FIG. 9 is a cross-sectional view of the valve sleeve shown in FIG. 8 taken along lines 9—9.
Figure 10:
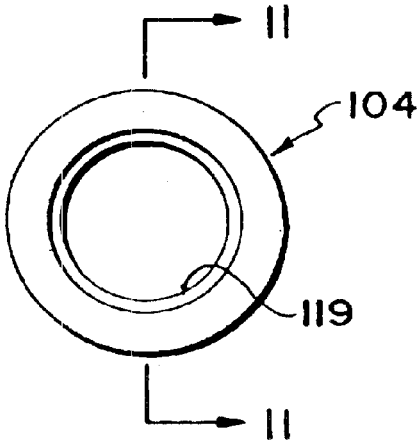
FIG. 10 is an end view of the valve muscle.
Figure 11:
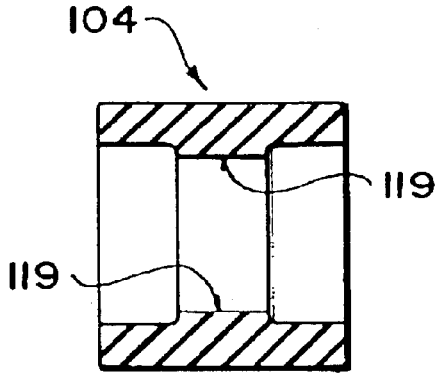
FIG. 11 is a cross-sectional view of the valve muscle shown in FIG. 10 taken along lines 11—11.

With reference to FIGS. 1 and 2, the inventor's centrifuge as shown in U.S. Pat. No. 5,462,513, which is incorporated herein by reference, and incorporating the present invention is designated by reference numeral 1. It has a frame 3, a shroud 4 consisting of shroud lid 5 and tailings launder 14, and drive motor 9. The frame is constructed of hollow steel sections. The shroud lid 5 has openings for a slurry feed pipe 18 and inspection ports 17 and an inner lining 32 of a wear resistant material such as LINATEX™. The flange of shroud lid 5 is bolted to an upper flange of tailings launder 14. Tailings launder 14 is provided with a tailings discharge port 19. Nested in tailings launder 14 is a concentrate launder 16 with a concentrate discharge port 20. The floors 22 and 24 respectively of launders 14 and 16 form helical spirals downwardly to assist in a smooth outward flow of the discharge and are preferably coated with an ultra-high molecular weight polyethylene. Water may be introduced at ports 26 to further assist the flow in the launder. The upper section of the tailings launder, where it forms the outer wall of the concentrate launder adjacent the output of flow control valves 37, is also provided with an inner lining 32 of a wear resistant material such as LINATEX™. The upper outside edge 7 of concentrate launder 16 extends into a circular slot 11 formed on the inner wall of tailings launder 14, forming a labyrinth barrier between the two launders.

Rotor 21 has an inner surface of rotor bowl 23 forming three zones: a migration zone, a retention zone and a lip zone, zones A, B and C respectively as described in U.S. Pat. No. 4,824,431, which is incorporated herein by reference, which cause the denser, target particles from the slurry flow to be concentrated in the retention zone. The rotor 21 is mounted in the frame 3 by assemblies 25. The rotor has a sheave 27 which is driven by a belt (not shown) driven by electric motor 9. The rotor is provided with hopper rings 35 and flow control valves 37, which will be described in further detail below. An impeller 28 is provided on the center of the floor of bowl 23 which has three or four upstanding vanes to assist in the rotation of the slurry. A continuous ½-inch slot 55 is formed in the surface of the retention zone B between the lower edge of the inner surface of lip 31 and the upper edge of the inner surface of lower bowl 30. Slot 55 opens to a series of mass-flow hoppers formed between two polyurethane hopper rings which hoppers in turn open to the flow control valves 37.

Rotor bowl 23 is formed of a steel lower bowl section 30, and steel lip 31. The inner surface of the rotor bowl has a lining 32 of a wear resistant material such as a ¼-inch layer of LINATEX™. Air supply pipe 36 runs up the center of rotor shaft 34 and connects the rotating union adapter 39 to flow control valves 37. Union adapter 39 connects the rotor shaft to rotating union 50. A cover 51 is provided to shield the union 50 and adapter 39.

The flow control valves 37 are operated by compressed air which is supplied to the rotor by rotating union 50. The purpose of the rotating union is to provide the compressed air from a storage tank 52 (to which pressurized air is periodically supplied through 53) via two stationary supply lines 40 to the two rotating supply lines 36 without loss of pressure. Compressed air runs from tank 52 via line 155 through a filter, regulator and lubricator assembly (not shown) to a solenoid valve 56. Valve 56 has outlet line 40 and exhaust port 57. It operates so that compressed air is provided to the outlet line 40 and when compressed air is not provided to line 40, it is open to its exhaust port 57. An electronic control (not shown) can be provided to control the compressed air to the line 40 to be varied, and the exhaust port 57 can be throttled for fine tuning.

Flow control valves 37 are shown in detail in FIG. 3 through 11. They are generally "muscle valve", air controlled valves, modified versions of the type manufactured by The Clarkson Company. Each valve unit 37 consists of valve body 100, valve sleeve 102, valve muscle 104, end cap 106 and exit bushing 108. The valve body 100 is preferably cast from polyurethane plastic of hardness 75D and is relatively short in length to reduce particle acceleration in the valve. Each valve unit 37 has a central bore 110 formed in valve sleeve 102 which communicates with the hopper outlets. One end of sleeve 102 forms an annular flange 103 which is held in a corresponding depression 105 in valve body 100. Metal ring 115 is sealed at its end to valve body 100 and metal ring 117 is sealed to end cap 106 to retain the valve muscle 104 on either side of its central thicker area 119. The valve muscle 104 is slightly pre-compressed to fit in chamber 116. O-ring 107 seals between end cap 106 and valve body 100, and O-ring 109 seals the entrance to compressed air passage 112. Bolts 113, 125 secure the valve assembly to the machine, and screws 111 fasten the valve body 100 to end cap 106.

Compressed air passageway 11 communicates with the compressed air supply in the hopper assembly with passageway 114 extending to chamber 116 in which the valve muscle 104 is seated with a slight clearance around its outer surface. Unlike other valves of this type, due to the abrasive nature of the environment of this machine, the air passageways extend axially and are embedded in the body of the valve rather than extending perpendicularly from the valve body. When pressurized air is provided to passageway 114 and thereby to the exterior surface of the valve muscle 104, the sleeve 102 is compressed in the central region thereof and the diameter of the central bore 110 in the central region thereof is constricted, thereby constricting the flow of concentrate. By increasing the air pressure, the degree of constriction is increased. When air pressure to the valve in passageway 112 is reduced, the central region of sleeve 102 dilates. Thus the diameter of the central bore 110 can be varied continuously from a fully closed state to its maximum diameter while maintaining a generally circular cross-section. In fact, the cross-section shape of the bore remains circular until the diameter is about 50% of the open diameter, after which it pinches together between 4 sides and, as the bore becomes fully closed, pinches between 3 sides. This facilitates passing coarse particles even when the diameter is reduced and allows adjustment of the orifice while the machine is in operation.

Due to the high pressures involved in the device, it is necessary to relieve pressure to the outer surface of sleeve 102, and between sleeve 102 and valve muscle 104, by a pressure relief hole 130. This prevents transitory air leakage from chamber 116 around the ends of muscle valve 104 which otherwise would cause the sleeve 102 to balloon inwardly and out bore 110.

End plate 106 is secured to the valve body 100 through threaded holes 121 using screws 111 or the like. O-ring 107 is provided in annular depression 129 to seal the end plate 106 to the valve body 100. Bushing 108, of tungsten carbide or like material, around bore 110 resists abrasion from the flow of concentrate and may be rotated periodically to increase its part life. To secure the valve body 100 to the machine, bolt 113 is provided through hole 124. Two further bolts 125 are provided through slots 126. In this way the valve can be fully removed by removing bolt 113 and simply loosening the two remaining bolts 125.

In operation, air pressure is typically first applied to the flow control valves 37 to close them. Motor 9 is activated to rotate the rotor. The slurry feed is introduced to the spinning rotor through feed pipe 18. Centrifugal forces cause the slurry to climb up the inner surface of the rotor bowl past slot 55 before being expelled past lip 31, into tailings launder 14 and thence out of the machine through discharge port 19. The hoppers are initially empty prior to introduction of the slurry. They rapidly fill with solids as the slurry is introduced. The hopper outlets remain closed during the initial stage. As the process advances, heavier concentrate accumulates in the retention zone. This accumulation of concentrate fills the hoppers. The controlled opening of the flow control valves 37 now operates to remove some of the material from the hopper. Such material is expelled by centrifugal force through valve bore 110 into concentrate launder 16. The diameter of orifice 110 may be varied automatically by a process controller or manually. To prevent clogging, it can be programmed to automatically and periodically "burp" open from a constricted diameter of, for example ⅛ inches to an open diameter of ⅜ inches every few minutes. The preferred fully open diameter of sleeve 102 is ½ inch. Similarly, in a Kelsey jig for example, a vibration monitor could detect an imbalance condition indicating a blocked spigot which would then automatically enlarge the valve orifice.

Figure 12:
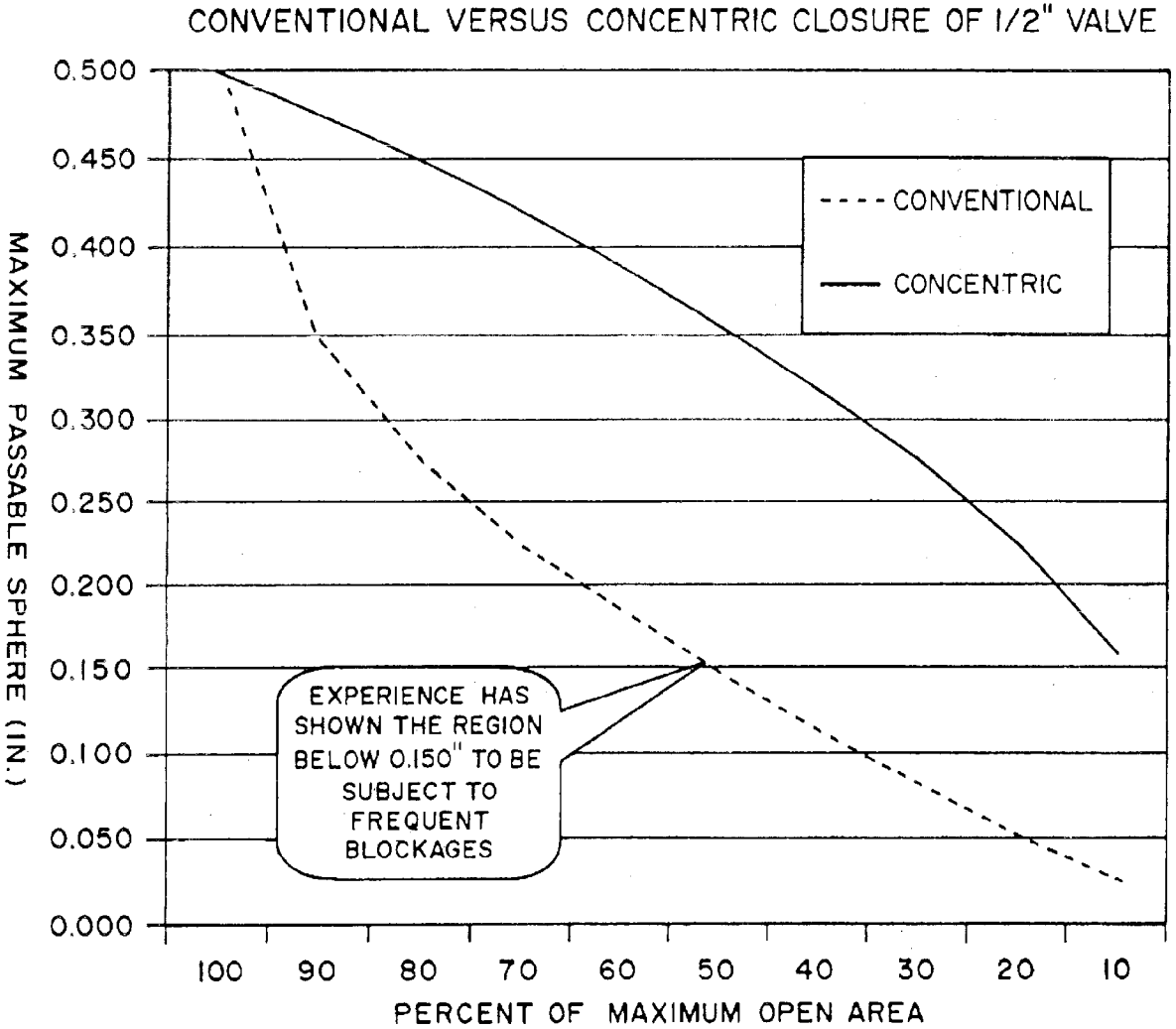
FIG. 12 is a chart comparing the size of particle which can pass through the valve of the present invention at a given flow constriction, to that of a conventional pinch valve.

FIG. 12 is a chart comparing the size of particle which can pass through the valve of the present invention at a given flow constriction, to that of a conventional pinch valve. The vertical axis plots the maximum diameter of sphere which can pass through the orifice which is ½ inch at its maximum opening. The horizontal axis plots the percentage of the maximum cross-sectional area to which the orifice is constricted. The solid line illustrates the performance of the concentric closure of the invention, while the doted line plots the conventional pinch valve, which is subject to frequent blockages when the maximum particle passage size hits 0.150 inches. The chart thus illustrates that the concentric closure of the present invention permits a greater percentage closure of the flow before reaching the limit of frequent blockage. This results from the fact that in the pinch valve, the perimeter of the orifice remains constant while its shape changes to reduce the cross-sectional area, while in the present invention the perimeter of the orifice decreases as the cross-sectional area decreases.

As will be apparent to those skilled in the art, various modifications and adaptations of the structure above described may be made without departing from the spirit of the invention, the scope of which is to be construed in accordance with the accompanying claims.

We claim:

1. A centrifugal concentrator for separating particulate material of higher specific gravity from particulate material of lower specific gravity, comprising a) a rotating member adapted for rotation about an axis, (b) material supply means to deliver said particulate material into said rotating member, c) a plurality of cavities for receiving said particulate material of higher specific gravity, extending radially outwardly with respect to the axis of rotation of said rotating member, said cavities each having an outwardly-extending outlet, and d) a flow control valve for controlling the flow of material from said outwardly-extending outlets of said cavities; wherein said flow control valve comprises a fluid inlet communicating with said outwardly-extending outlet, a fluid outlet and a passage communicating therebetween and having a cross-sectional radius in the plane perpendicular to the longitudinal axis of said passage, wherein said passage is radially constrictible from a fully open to a closed condition while maintaining a cross-sectional shape which is substantially circular over a major range of such radial constriction wherein said flow control valve comprises a cylindrical elastomeric valve member disposed within said passage, and an annular elastomeric constrictor element mounted coaxially around said cylindrical elastomeric valve member and having a central thickened region for contacting and constricting said cylindrical elastomeric valve member and wherein said flow control valve further comprises a valve body, said valve body comprising a passageway communicating with a compressed gas supply for supplying gas under pressure to the exterior of said annular elastomeric constrictor element to thereby constrict said passage, and wherein said flow control valve comprises a pressure relief passage extending from the outer surface of said cylindrical elastomeric valve member, at a location axially inwardly from said annular elastomeric constrictor element, and communicating to the exterior of the valve body.

2. The centrifugal concentrator of claim 1 where in said radially constrictible passage of said flow control valve has a cross-sectional shape which is substantially circular over at least half said range of radial constriction of said passage.

3. The centrifugal concentrator of claim 1 wherein said radially constrictible passage of said flow controlling means has a maximum dimension in the plane perpendicular to the longitudinal axis of said passage which remains comparable to the dimension of said passage perpendicular to said maximum dimension over a substantial range of radial constriction of said passage.

4. The centrifugal concentrator of claim 1 wherein said radially constrictible passage of said flow control valve has a maximum diameter of at least one-half inch.

5. The centrifugal concentrator of claim 1 wherein said range of radial constriction of said passage is from at least as small as ⅛ inch to at least as great as ½ inch.

6. The centrifugal concentrator of claim 1 wherein said annular elastomeric constrictor element is held in a chamber in said valve body and is pre-compressed to fit said chamber.

7. The centrifugal concentrator of claim 1 wherein said passageway communicating with a compressed gas supply for supplying gas under pressure to the exterior of said annular elastomeric constrictor element extends substantially axially within said valve body.

8. The centrifugal concentrator of claim 1 wherein said gas is air.

9. A flow control valve for a centrifugal concentrator for separating particulate material of higher specific gravity from particulate material of lower specific gravity, wherein said centrifugal concentrator comprises a) a rotating member adapted for rotation about an axis, (b) material supply means to deliver said particulate material into said rotating member, and c) a plurality of cavities for receiving said particulate material of higher specific gravity, extending radially outwardly with respect to the axis of rotation of said rotating member, said cavities each having an outwardly-extending outlet; said flow control valve controlling the flow of material from said outwardly-extending outlet; wherein said flow control valve comprises a fluid inlet communicating with said outwardly-extending outlet, a fluid outlet and a passage communicating therebetween and having a cross-sectional radius in the plane perpendicular to the longitudinal axis of said passage, wherein said passage is radially constrictible from a fully open to a closed condition while maintaining a cross-sectional shape which is substantially circular over a major range of such radial constriction and wherein said flow control valve comprises a cylindrical elastomeric valve member disposed within said passage, and an annular elastomeric constrictor element mounted coaxially around said cylindrical elastomeric valve member and having a central thickened region for contacting and constricting said cylindrical elastomeric valve member and wherein said flow control valve further comprises a valve body, and said valve body comprises a passageway communicating with a compressed gas supply for supplying gas under pressure to the exterior of said annular elastomeric constrictor element to thereby constrict said passage, and wherein said flow control valve comprises a pressure relief passage extending from the outer surface of said cylindrical elastomeric valve member, at a location axially inwardly from said annular elastomeric constrictor element, and communicating to the exterior of the valve body.

10. The flow control valve of claim 9 wherein said radially constrictible passage of said flow control valve has a cross-sectional shape which is substantially circular over at least half said range of radial constriction of said passage.

11. The flow control valve of claim 9 wherein said radially constrictible passage of said flow control valve has a maximum dimension in the plane perpendicular to the longitudinal axis of said passage which remains comparable to the dimension of said passage perpendicular to said maximum dimension over a substantial range of radial constriction of said passage.

12. The flow control valve of claim 9 wherein said radially constrictible passage of said flow control valve has a maximum diameter of at least one-half inch.

13. The flow control valve of claim 9 wherein said range of radial constriction of said passage is from at least as small as ⅛ inch to at least as great as ½ inch.

14. The flow control valve of claim 9 wherein said annular elastomeric constrictor element is held in a chamber in said valve body and is pre-compressed to fit said chamber.

15. The flow control valve of claim 9 wherein said passageway communicating with a compressed gas supply for supplying gas under pressure to the exterior of said annular elastomeric constrictor element extends substantially axially within said valve body.

16. The flow control valve of claim 9 wherein said gas is air.

* * * * *